US005848774A

United States Patent [19]

Bogage

[11] Patent Number: 5,848,774

[45] Date of Patent: Dec. 15, 1998

[54] AIR CURTAIN MOUNTING PLATE AND STRUCTURE

[75] Inventor: Gerald L. Bogage, Coral Gables, Fla.

[73] Assignee: Leading Edge, Inc., Miami, Fla.

[21] Appl. No.: 864,373

[22] Filed: May 28, 1997

[51] Int. Cl.[6] ..... A47H 1/10; F24F 9/00

[52] U.S. Cl. ..... 248/317; 454/188

[58] Field of Search ..... 248/317, 339, 248/342; 454/188, 190, 192

[56] References Cited

U.S. PATENT DOCUMENTS

| | | | |
|---|---|---|---|
| 3,145,641 | 8/1964 | Morrison | 454/192 |
| 3,157,105 | 11/1964 | Tamm et al. | 454/192 |
| 3,211,077 | 10/1965 | Kramer, Jr. | 454/190 |
| 3,229,609 | 1/1966 | Larson et al. | 454/190 |
| 3,327,935 | 6/1967 | Berlant | 454/192 |
| 3,362,469 | 1/1968 | Berner et al. | 166/122 |
| 4,783,040 | 11/1988 | Lindberg et al. | 248/74.3 |
| 5,072,658 | 12/1991 | Bogage | 454/188 |

*Primary Examiner*—Leslie A. Braun
*Assistant Examiner*—Anita M. King
*Attorney, Agent, or Firm*—Hoffman, Wasson & Gitler, P.C.

[57] ABSTRACT

An air curtain mounting structure which includes mounting plates with T-shaped mounting tabs extending upward. Each end of the air curtain cabinet has a pair of slots formed in the upper surface near the side walls of the cabinet. The slots are collinear and a spaced apart a distance equal to the distance between the mounting tabs. The mounting plates are attached to the side walls of the air curtain cabinet. A pair of hollow, parallel, steel channels are provided having a groove in a bottom surface so that the mounting tabs are supported by the channels. The channels may further be attached to cross members which in turn are suspended from rods or triangular brackets. The rods depend from a ceiling or other support structure, while the triangular bracket attach to a wall. Multiple air curtains may be positioned in side-by-side configuration.

20 Claims, 8 Drawing Sheets

AIR CURTAIN MOUNTING PLATE AND STRUCTURE

FIELD OF THE INVENTION

The present invention relates to a mounting plate and structure for an air curtain. In particular, the present invention pertains to a mounting plate and mounting structure which supports a high volume air curtain at doorways to provide a thermal barrier which helps to contain heat or air conditioning, and maintains clean air. The mounting plate attaches to the sides of the air curtain and either hangs from a ceiling or supporting structure depending down from the ceiling or outward from a wall.

BACKGROUND OF THE INVENTION

The employment of air curtains to contain heat or air conditioning is widely known. The size of air curtain depends on the its location and the size of the doorway or opening to which it is intended to create a barrier. The doorways are commonly 14 to 16 feet high and may be as much as 8 to 16 feet wide. In order to create a sufficient air barrier for doorways having such dimensions, the air curtain unit must be fairly large and may weigh between approximately 300 to 900 lbs.

The process of installing air curtains can be difficult due to their size and weight. In addition, depending upon the location of the doorway, for which the air curtain is supposed to create a barrier, there may be no available structure to attached the air curtain to. For example, many warehouses have an open interior structure with significant ceiling heights, such as 20' ceilings, with no intervening structure. In such circumstances it is difficult to install, locate, and maintain the air curtain in the desired position and with a proper orientation.

It is an object of the present invention to provide an air curtain mounting structure which can support an air curtain in a wide variety of different location.

It is a further object of the present invention to provide an air curtain mounting structure which can attach to a ceiling.

Another object of the present invention to provide an air curtain mounting structure which can properly position an air curtain near a doorway regardless of the height of a ceiling above the air curtain.

Still another object of the present invention to provide an air curtain mounting structure which can be attached to a wall above a doorway.

Yet another object of the present invention to provide an air curtain mounting structure which is relatively easy to install and maintain.

SUMMARY OF THE INVENTION

According to one aspect of the present invention, an air curtain mounting structure which includes mounting plates with T-shaped mounting tabs extending upward is provided. Each end of the air curtain cabinet has a pair of slots formed in the upper surface near the side walls of the cabinet. The slots are collinear and a spaced apart a distance equal to the distance between the mounting tabs. The mounting plates are attached to the side walls of the air curtain cabinet. A pair of hollow, parallel, steel channels are provided having a groove in a bottom surface so that the mounting tabs are supported by the channels. The channels may further be attached to cross members which in turn are suspended from rods or triangular brackets. The rods depend from a ceiling or other support structure, while the triangular bracket attach to a wall. Multiple air curtains may be positioned in side-by-side configuration.

BRIEF DESCRIPTION OF THE DRAWINGS

The foregoing and other objects and attributes of the present invention will be described with respect to the following drawings in which.

DETAILED DESCRIPTION OF THE PREFERRED EMBODIMENT

Figure 1:
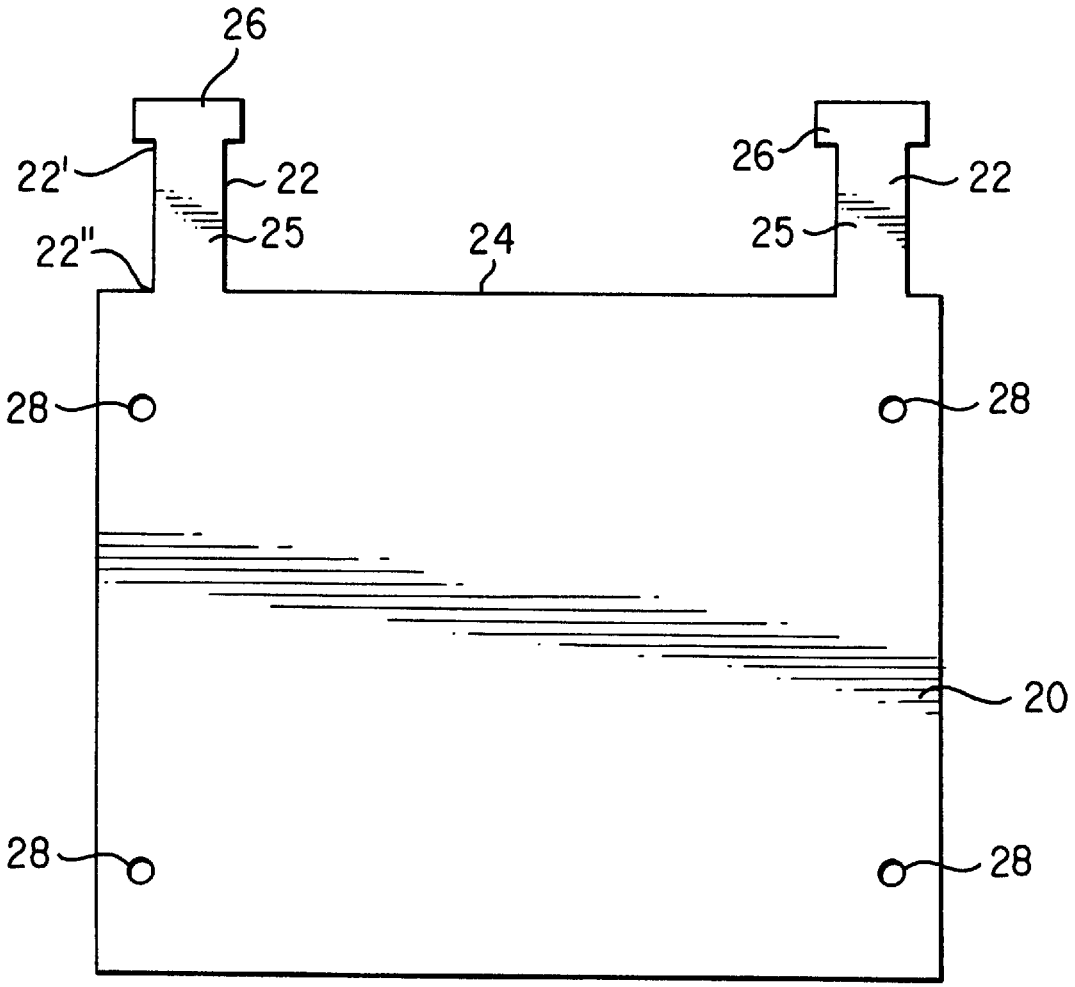
FIG. 1 is a side view of mounting plate according to the present invention.
Figure 2:
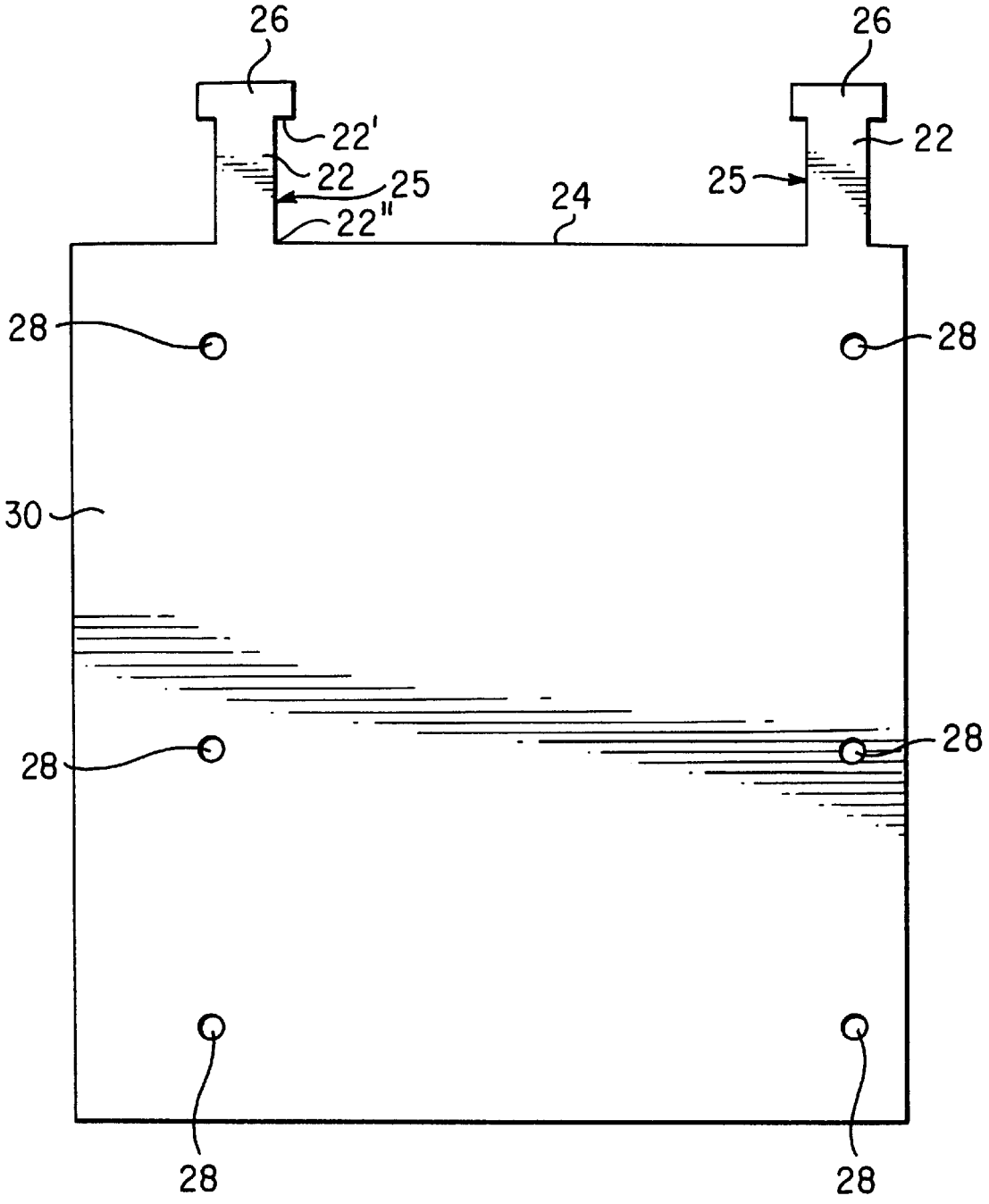
FIG. 2 is a side view of a second mounting plate according to the present invention.
Figure 3:
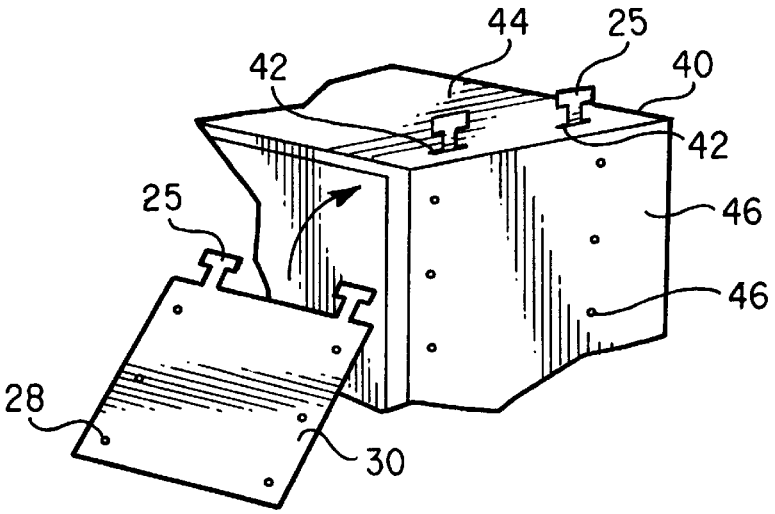
FIG. 3 is a partial perspective view of the mounting plate shown in FIG. 2 as it attaches to an air curtain according to the present invention.

Referring to FIGS. 1–3, two embodiments of the mounting plate and their attachment to an air curtain is shown. The mounting plate 20 shown in FIG. 1 is intended to be used with relatively small size air curtains. The mount plate 20 has a substantially rectangular shape with two mounting tabs 25 projecting from an upper edge 24. Four bolt holes 28 are provided in the mounting plate 20. Bolts (not shown) are inserted through corresponding holes in the side of the air curtain to secure the mounting plate 20 to the air curtain.

The mounting plate 30 shown in FIG. 2 is intended for use with relatively large air curtains. The mounting plate 30 has the same two mounting tabs 25 extending from an upper edge 24. The mounting plate 30 is larger than the mount plate 20 shown in FIG. 1, and has six bolt holes 28 instead of two.

Each of the mounting tabs 25 is substantially T-shaped, with a vertical projection 22 extending perpendicular to the upper edge 24 of the mounting plate 20 or 30. A horizontal flange 26 is formed integrally with the vertical projection 22, and extends parallel to the upper edge 24 of the mounting plate 20 or 30. The horizontal flange 26 is formed on an outer end 22' of the vertical projection 22, while the mounting plate 20 or 30 meets the vertical projection 22 at an inner end 22". The mounting tabs 25 are formed integrally with the mounting plate 20 or 30, and they are preferably made from metal such as steel.

Referring now to FIG. 3, attachment of the mounting plate 30 to an air curtain cabinet 40 is illustrated. For illustrative purposes the details of the air curtain which are not pertinent to the present invention are not shown, FIG. 3 illustrates only a portion of the cabinet 40 housing the air curtain. The cabinet 40 is substantially rectangular in all dimensions. Each end of the air curtain cabinet 40 has a pair of slots 42 formed in the upper surface 44 near the side walls 46 of the cabinet 40. The slots 42 are collinear and a spaced apart a distance equal to the distance between the mounting tabs 25 on the mounting plate 30.

The sides of the cabinet 40 also have bolt holes 48 which correspond to the bolt holes 28 in the mounting plate 30. A mounting plate 30 is positioned inside each of the side walls 46 so that the mounting tabs 25 extend through the slots 42 in the upper surface 44 of the cabinet 40. The mounting plates 30 are coplanar with the side walls 46 of the cabinet and are held in position by six bolts, not shown, extending through bolt holes 28 and 48.

Figure 14:
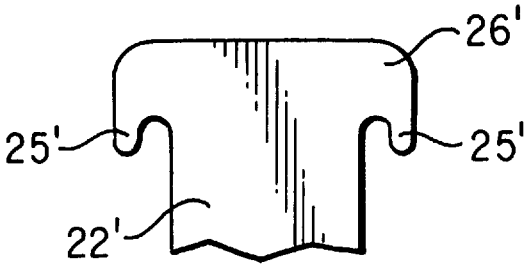
FIG. 14 is a side view of an alternative vertical projection and horizontal flange configuration.

Referring to FIG. 14, an alternative configuration of a vertical projection 22' and horizontal flange 26' are shown. This configuration corresponds to the configuration shown in FIGS. 1–3, however, the horizontal flange 26' has a pair of downwardly extending protrusions 25' extending from the outer edges of the flange 25'. These downward protrusions 25' are intended to interact with holes formed in the top of the cabinet 40 adjacent the slots 42, shown in FIG. 3, and discussed below. As a result of this configuration, the air curtain suspended in a more stable manner. The protrusions 25' create a more positive interlocking of the air curtain with cabinet. The resulting installation is considerably more stable. In the configuration shown in FIGS. 1 and 2, the flanges 26, each provide approximately no more than a couple of millimeters on either side of the vertical projection 22.

Figure 4:
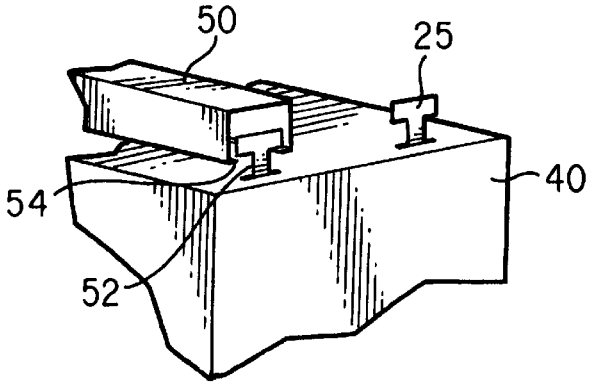
FIG. 4 is a partial perspective view of an air curtain have a mounting plate attached thereto, further attached to structural steel channels.

FIG. 4 illustrates the interconnection of a cabinet 40, having a mounting plate 30 attached thereto, to a steel channel structure 50. Only one steel channel 50 is shown in FIG. 4, however, it is intended that two parallel channels 50 will be provided, as shown in other figures, discussed below.

Each steel channel 50 is hollow and has an open groove 52 in its bottom surface 54. The steel channel 50 is slightly wider than the horizontal flanges 26 on the mount tabs 25. The groove 52, similarly, is slightly wider than the width of vertical projections 22 of the mounting tabs 25. The groove 52 is formed lengthwise in the bottom surface 54 substantially dividing the bottom surface 54 into two inwardly extending lips 54*a* and 54*b*, shown in FIG. 5.

Figure 5:
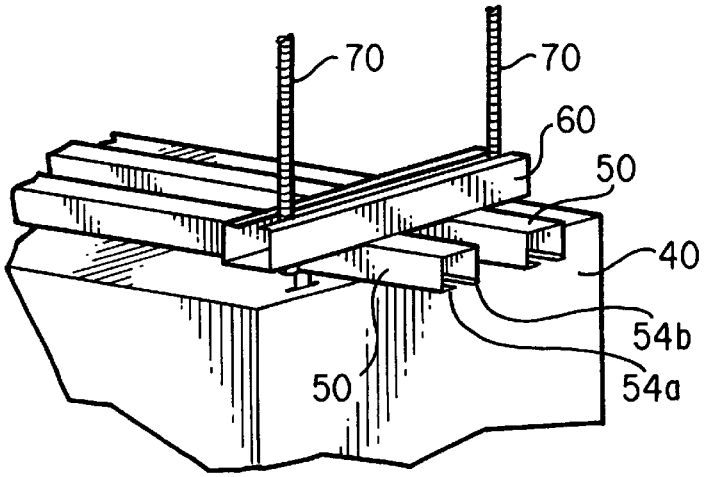
FIG. 5 is partial perspective view of mounting plate and air curtain of FIG. 4 depending from a suspension rod arrangement according to the present invention.

The steel channel fits over the mounting tabs 25 so that the flange 26 rest on the lips 54*a* and 54*b* with the vertical projections extending down through the groove 52, thereby suspending the air curtain from the channels 50. As shown in FIG. 5 the channels 50 may further be attached to cross members 60 which in turn is suspended from rods 70. The rods 70 depend from ceiling or other support structure in a conventional manner. The cross member 60 is attached with nuts to the threaded ends of the rods 70. The air curtain is attached to the cross member after the installation of the rods 70 and cross member 60.

Figure 6A:
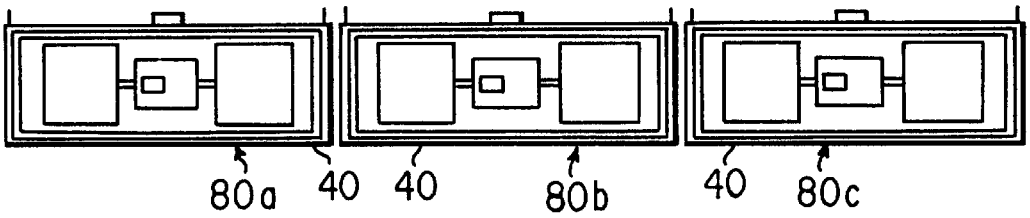
FIGS. 6*a*–6*e* are side views of steps for installing three separate air curtains arranged in side by side relationship according to the present invention.
Figure 6B:
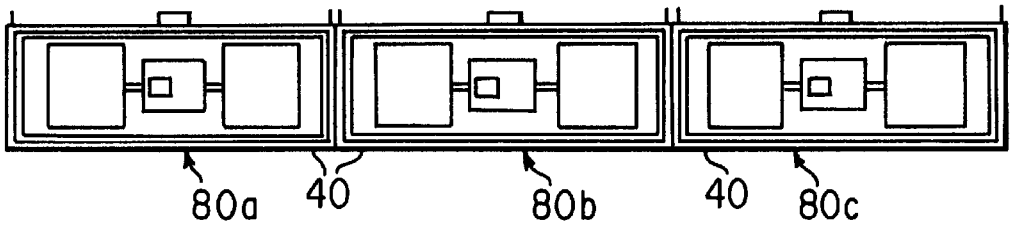

Referring to FIGS. 6*a*–6*e*, the installation of three air curtains arranged in side-by-side configuration is shown. This configuration is the subject of assignees U.S. Pat. No. 5,072,658. The present invention is compatible with the modular air curtain design of the 5,072,658 patent. In FIG. 6*a* three air curtains 80*a*, 80*b*, and 80*c* are positioned in side-by-side configuration. In FIG. 6*b* the three air curtains 80*a*, 80*b* and 80*c* have their cabinets 40 bolted together. The bolts attaching the air curtains together extend through the bolt holes 48 in the sides 44 of the cabinets 40 and the bolt holes 28 in the mounting plates 30.

Figure 6C:
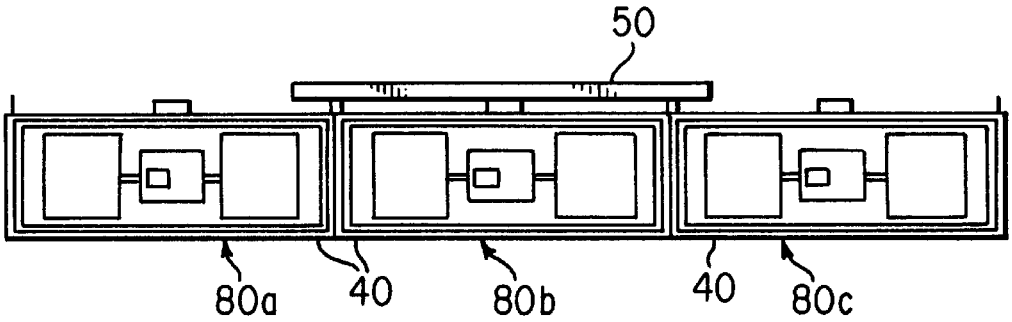
Figure 6D:
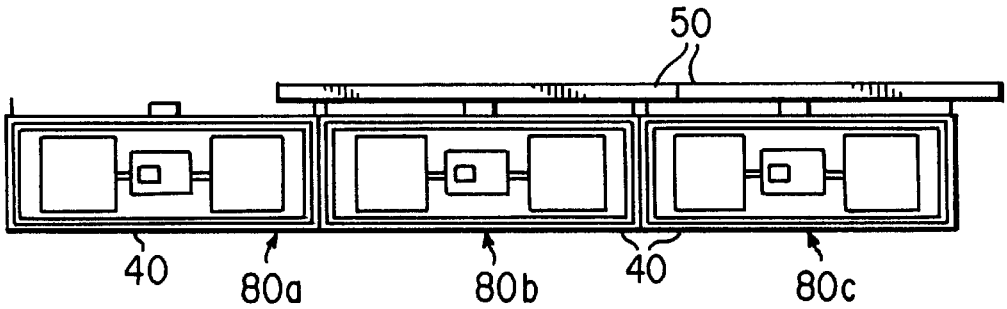
Figure 6E:
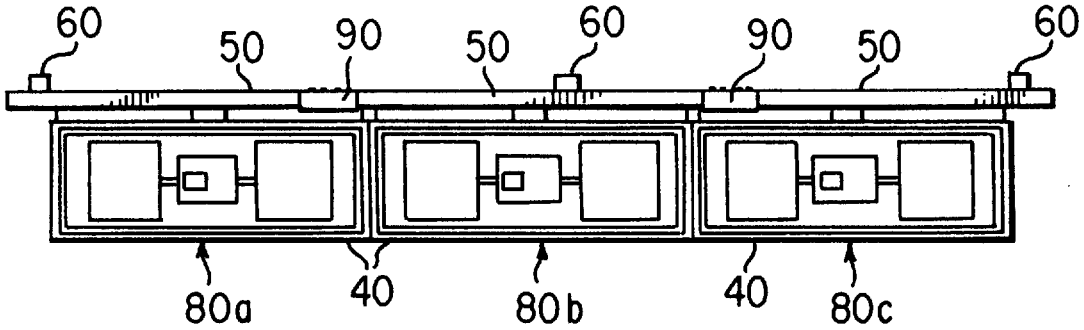

Next, as shown in FIG. 6*c*, a length of steel mounting channels 50 are positioned over the mounting tabs 25 of the center air curtain 80*b*. Mounting channels 50 are then slid over the mounting tabs 25 of the air curtain 80*c*, as shown in FIG. 6*d*. A pair of mounting channels 50 are then slid over the mount tabs 25 extending up from air curtain 80*a*, as shown in FIG. 6*e*.

Figure 7:
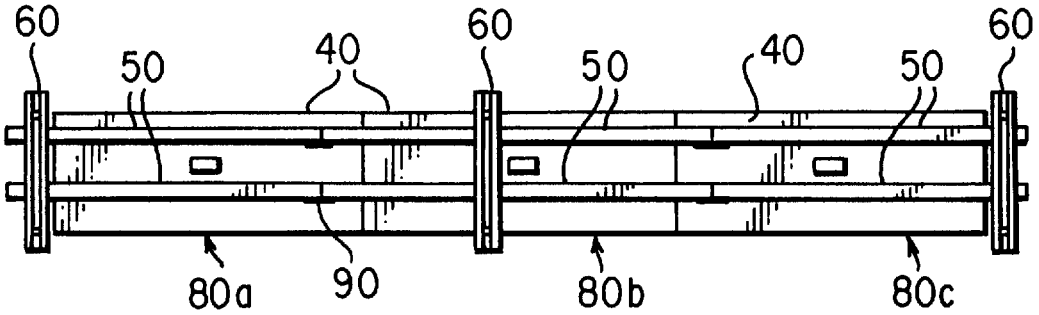
FIG. 7 is a top view of the three air curtains shown in FIG. 6*e* according to the present invention.
Figure 8:
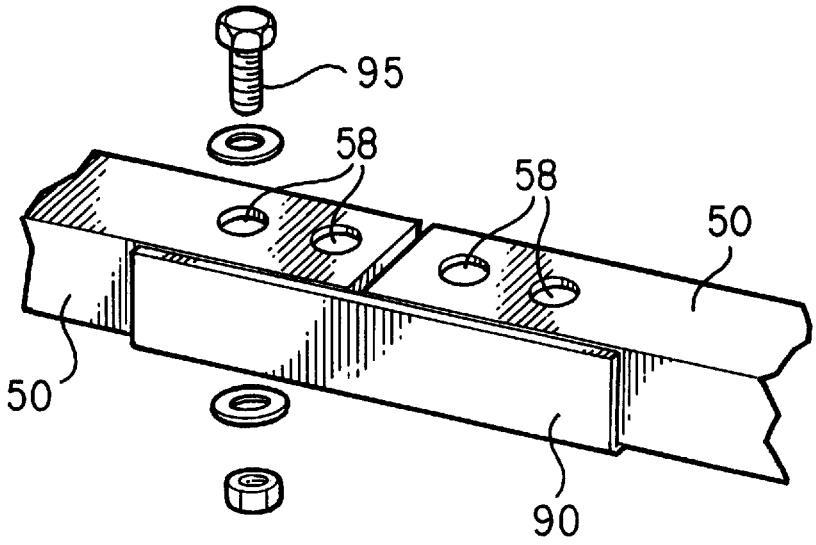
FIG. 8 is a partial perspective view of two interconnected structural steel channels according to the present invention.

Referring to FIG. 7, the mounting channels 50 over each of the air curtains 80*a*, 80*b*, and 80*c* form two extended parallel mounting channels 50. The lengths of steel mounting channel 50 are interconnected to one another as shown in FIG. 8. U-shaped connecting plates 90 are provided so that they surround the sides and bottom of the steel mounting channels 50. The upper surfaces 56 of the steel channels 50 have holes 58 formed therein. The bottom portion of each of the U-shaped connecting plates 90 has holes formed therein so that adjacent steel plates may be connected with bolt bolts 95.

The three air curtains 80*a*–80*c* can depend from rods 70 and three cross members 60, shown in detail in FIG. 5, as shown in FIG. 7. From the foregoing, it is clear that the mounting structure of the present invention is adaptable to doorways having very large widths. Multiple air curtains can be connected to provide air curtains which are a barrier for such large doorways.

Figure 9:
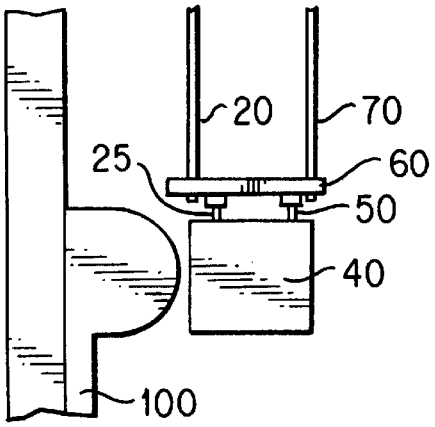
FIG. 9 is a side view of an air curtain mounting structure having a suspension rod installation according to the present invention, mounted adjacent a roll-up door.

The air curtain mounting structure of the present invention can by altered depending at least partially upon the type of door for which the curtain is creating a barrier. FIG. 9 shows a side view of an air curtain mounting structure having a suspension rod 70 and cross member 70 installation according to the present invention, mounted adjacent a roll-up door 100. The air curtain is disposed to be horizontally adjacent the roll housing 110 of the roll-up door 100.

Figure 10:
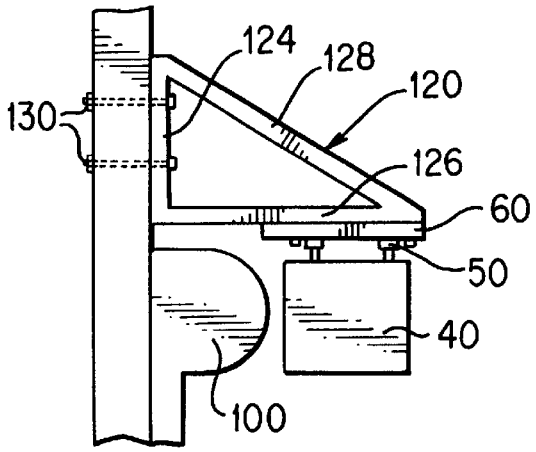
FIG. 10 is a side view of an air curtain mounting structure having a wall bracket installation according to the present invention, mounted adjacent a roll-up door.

According to FIG. 10, a side view of a second air curtain mounting structure is illustrated having a wall bracket installation 120 mounted adjacent a roll-up door 100. The wall bracket installation 120 includes at least two wall brackets 120 which are triangular shaped. A vertical leg 124 of the triangular wall bracket 120 is attached to a wall above the roll-up door 100 by bolts 130. The cross members 60 are bolted to horizontal legs 126 of the wall brackets 120, in place of rods 70. The angle leg 128 transverse the space between the legs 124 and 126 to add further support for the air curtain. As was the case with the air curtain in FIG. 9, the air curtain is disposed to be horizontally adjacent the roll housing of the roll-up door 100.

Figure 12:
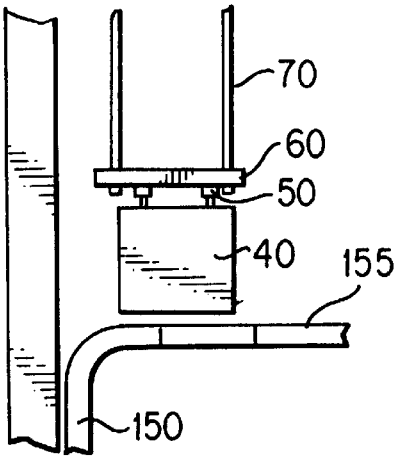
FIG. 12 is a side view of an air curtain mounting structure having a suspension rod installation according to the present invention, mounted adjacent a low turn back track door.
Figure 11:
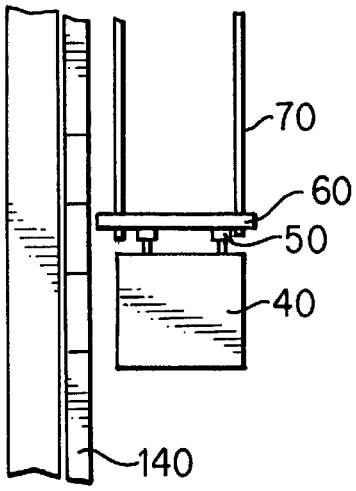
FIG. 11 is a side view of an air curtain mounting structure having a suspension rod installation according to the present invention, mounted adjacent a high-rise track door.
Figure 13:
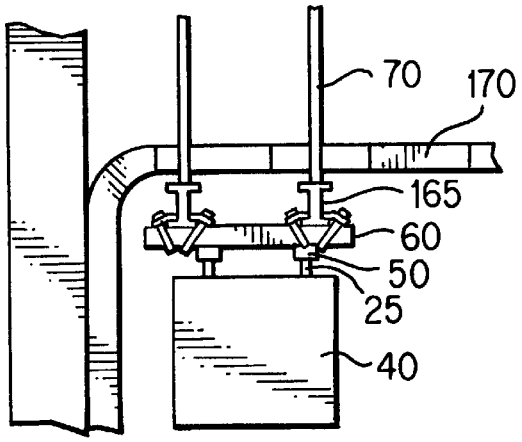
FIG. 13 is a side view of an air curtain mounting structure having suspension rod installation according to the present invention, mounted adjacent a high turn back track door using additional I-beam supports.

FIG. 11 shows a side view of an air curtain mounting structure similar to the suspension rod arrangement shown in FIG. 9, mounted adjacent a high-rise track door 140. FIG. 12 is a side view of an air curtain mounting structure having a suspension rod arrangement, mounted adjacent a low turn back track door 150. The air curtain is disposed above the tracks 155. Finally, FIG. 13 illustrates a side view of an air curtain mounting structure having a suspension rod arrangement mounted adjacent a high turn back track door. In such an arrangement additional I-beam supports 165 may be employed between the rods 70 and the cross members 60. The rods 70 can thereby be spaced far enough apart to provide clearance for the high turn back track 170.

Having described the preferred embodiments of the air curtain mounting structure according to the present invention, it is believed that other modifications, variations and changes will be suggested to those skilled in the art in view of the description set forth above. For example, the number of mounting tabs may be increased, a single channel having two grooves in its bottom surface may be used, and the location and orientation of the mounting tabs can be altered. It is therefore to be understood that all such variations, modifications and changes are believed to fall within the size of the present invention as defined in the appended claims.

What is claimed is:

1. A mounting structure for an air curtain comprising:

an air curtain cabinet;

a pair of mounting plates each having a pair of T-shaped mounting tabs extending upward from an upper edge of each of said pair of mounting plates;

said air curtain cabinet having two sets of slots formed in an upper surface, said pair of T-shaped mounting tabs of each of said mounting plates extending one of said sets of slots; and a pair of channels extending above said air curtain cabinet, said channels each having a groove formed in a bottom surface, said T-shaped mounting tabs extending into said groove.

2. A mounting structure for an air curtain as recited in claim 1, wherein said pair of mounting plates are disposed, one each, near ends of said air curtain cabinet.

3. A mounting structure for an air curtain as recited in claim 2, wherein said pair of mounting plates are attached to said ends of said air curtain cabinet.

4. A mounting structure for an air curtain as recited in claim 3, wherein said pair of mounting plates have holes formed therein and said ends of said air curtain cabinet have holes formed therein corresponding to said holes in said pair of mounting plates, and said ends of said air curtain cabinet are connected to respective ones of said pair of mounting plates by bolts extending through said holes in said ends of said air curtain cabinet and said holes in said pair of mounting plates.

5. A mounting structure for an air curtain as recited in claim 4, wherein multiple ones of said air curtains are mounted to one another.

6. A mounting structure for an air curtain as recited in claim 5, wherein said multiple air curtains are mounted to one another by bolts extending through said holes in said ends of adjacent ones of said air curtain cabinets and said holes in said pair of mounting plates, mounted in said ends of said adjacent air curtain cabinets.

7. A mounting structure for an air curtain as recited in claim 5, wherein said channels for attachment to adjacent ones of said air curtains are connected to one another by attaching plates.

8. A mounting structure for an air curtain as recited in claim 7, wherein said attaching plates are U-shaped.

9. A mounting structure for an air curtain as recited in claim 8, wherein said U-shaped attaching plates surround said bottom surface and sides of said channels, and are connected with bolts.

10. A mounting structure for an air curtain as recited in claim 1, wherein said groove is disposed between two lips which extend inward toward said groove, and wherein said T-shaped mounting tabs have a horizontal flange forming a top of said T-shaped flange, said horizontal flange being disposed on said two lips when said air curtain is installed.

11. A mounting structure for an air curtain as recited in claim 1, further comprising at least two cross members attached to an upper surface of said pair of channel members.

12. A mounting structure for an air curtain as recited in claim 11, wherein said cross members are attached to ends of vertically oriented rods.

13. A mounting structure for an air curtain as recited in claim 11, wherein said cross members are attached to I-beams extending parallel to said pair of channels.

14. A mounting structure for an air curtain as recited in claim 13, wherein said I-beams are longer than said pair of channels.

15. A mounting structure for an air curtain as recited in claim 13, wherein said I-beams are attached to ends of vertically oriented rods.

16. A mounting structure for an air curtain as recited in claim 11, further comprising triangular brackets connected to a wall to which said cross members are attached.

17. A mounting structure for an air curtain as recited in claim 16, wherein said triangular brackets include a horizontally oriented leg to which said cross members are attached.

18. A mounting structure for an air curtain as recited in claim 17, wherein said triangular brackets include a vertically oriented leg attached to said wall.

19. A mounting structure for an air curtain as recited in claim 18, wherein said triangular brackets further comprise a transverse leg interconnecting said horizontally oriented leg and said vertically oriented leg.

20. A mounting structure for an inner curtain as recited in claim 1, wherein each of said T-shaped mounting tabs has a pair of downwardly projecting protrusions, extending from the outer edges of a horizontal portion of said T-shaped mounting tab, said protrusions interacting with holes formed in the top of said air curtain cabinet to interlock said mounting plates and said air curtain cabinet.

* * * * *